US005173153A

United States Patent [19]

Terrett et al.

[11] Patent Number: 5,173,153

[45] Date of Patent: * Dec. 22, 1992

[54] PROCESS FOR ENHANCED OXYGEN DELIGNIFICATION USING HIGH CONSISTENCY AND A SPLIT ALKALI ADDITION

[75] Inventors: Stuart T. Terrett, Elgin, S.C.; Spencer W. Eachus, Allentown, N.J.; Bruce F. Griggs, Columbia, S.C.

[73] Assignee: Union Camp Patent Holding, Inc., Wilmington, Del.

[ * ] Notice: The portion of the term of this patent subsequent to Feb. 4, 2009 has been disclaimed.

[21] Appl. No.: 637,100

[22] Filed: Jan. 3, 1991

[51] Int. Cl.[5] ..... D21C 9/147

[52] U.S. Cl. ..... 162/40; 162/56; 162/57; 162/65

[58] Field of Search ..... 162/19, 18, 56, 57, 162/65, 40, 88, 89

[56] References Cited

U.S. PATENT DOCUMENTS

| | | | |
|---|---|---|---|
| 1,860,432 | 5/1932 | Richter . | |
| 2,926,114 | 2/1960 | Grangaard et al. | 260/212 |
| 3,024,158 | 3/1962 | Grangaard et al. | 162/17 |
| 3,251,730 | 5/1966 | Watanabe | 162/56 |
| 3,274,049 | 9/1966 | Gaschke et al. | 162/65 |
| 3,384,533 | 5/1968 | Meylan et al. | 162/65 |
| 3,423,282 | 1/1969 | Rerolle et al. | 162/65 |
| 3,652,388 | 3/1972 | Croon et al. | 162/65 |
| 3,660,225 | 6/1972 | Verreyne et al. | 162/17 |
| 3,661,699 | 5/1972 | Farley | 162/65 |
| 3,740,310 | 6/1973 | Smith et al. | 162/65 |
| 3,759,783 | 9/1973 | Samuelson et al. | 162/65 |

(List continued on next page.)

FOREIGN PATENT DOCUMENTS

| | | |
|---|---|---|
| 1119360 | 3/1982 | Canada . |
| 1132760 | 10/1982 | Canada . |
| 1154205 | 9/1983 | Canada . |
| 062539 | 10/1982 | European Pat. Off. . |
| 106460 | 4/1984 | European Pat. Off. . |
| 106609 | 4/1984 | European Pat. Off. . |

OTHER PUBLICATIONS

Abrahamsson et al., "Oxygen/Sodium Carbonate Bleaching of Kraft Pulp Pretreated with Nitrogen Dioxide and Oxygen", Svensk Papperstidning (1983).

Allison, "Production of Bleached Softwood Pulp by Low Pollution Processes", Wood Sci. Technol. 17, pp. 129-137 (1983).

Andtbaka, "Low Kappa Pulping Followed by Oxygen Delignification", Appita, vol. 39, No. 2, (1986).

Brannland et al., "How to Cope With TOCL", International Oxygen Delignification Conference, (1987).

Carlberg et al., "Bleaching of Sulphite and Sulphate Pulps Using Conventional and Unconventional Sequences", TAPPI Proceedings 1982 Annual Meeting, p. 381.

Casey, J. P., "Bleaching: A Perspective", *TAPPI Journal*, vol. 66, No. 7 (Jul. 1983) p. 95.

Christensen, P. K., "Bleaching of Sulphate Pulps With Hydrogen Peroxide".

DeSousa et al., "The influence of Chlorine Ratio and Oxygen Bleaching on the Formation of PCDF's and PCCD's in Pulp Bleaching", Tappi Journal (Apr. 1989).

(List continued on next page.)

*Primary Examiner*—Steve Alvo

*Attorney, Agent, or Firm*—Pennie & Edmonds

[57] ABSTRACT

Unbleached pulp is combined with an aqueous alkaline solution while in a state of low consistency to distribute a first amount of alkaline material substantially uniformly throughout the pulp. The consistency of the pulp is then increased to above about 20%. Additional alkali is applied onto the high consistency pulp to provide a total amount of between 0.8 and 7% by weight of oven dry pulp. The high consistency alkali containing pulp is then treated with oxygen to effect delignification. High strength, low lignin pulps are formed which may be further bleached to high brightness with reduced amounts of chemicals by following the methods of the invention.

15 Claims, 3 Drawing Sheets

U.S. PATENT DOCUMENTS

| | | | |
|---|---|---|---|
| 3,832,276 | 8/1974 | Roymoulik et al. | 162/65 |
| 3,874,992 | 4/1975 | Liebergott | 162/66 |
| 3,888,727 | 6/1975 | Kenig | 162/65 |
| 3,951,733 | 5/1976 | Phillips | 162/65 |
| 4,080,249 | 3/1978 | Kempf et al. | 162/57 |
| 4,089,737 | 5/1978 | Nagano et al. | 162/19 |
| 4,120,747 | 10/1978 | Sarge, III et al. | 162/117 |
| 4,155,806 | 5/1979 | Mannbro | 162/19 |
| 4,198,266 | 4/1980 | Kirk et al. | 162/29 |
| 4,220,498 | 9/1980 | Prough | 162/25 |
| 4,248,662 | 2/1981 | Wallick | 162/19 |
| 4,259,150 | 3/1981 | Prough | 162/65 |
| 4,274,913 | 6/1981 | Kikuiri et al. | 162/65 |
| 4,295,925 | 10/1981 | Bentvelzen et al. | 162/19 |
| 4,295,926 | 10/1981 | Bentvelzen et al. | 162/57 |
| 4,298,426 | 11/1981 | Torregrossa et al. | 162/57 |
| 4,298,427 | 11/1981 | Bentvelzen et al. | 162/57 |
| 4,363,697 | 12/1982 | Markham et al. | 162/19 |
| 4,372,812 | 2/1983 | Phillips | 162/40 |
| 4,384,920 | 5/1983 | Markham et al. | 162/19 |
| 4,431,480 | 2/1984 | Markham et al. | 162/19 |
| 4,435,249 | 2/1984 | Markham et al. | 162/24 |
| 4,439,271 | 3/1984 | Samuelson | 162/19 |
| 4,450,044 | 5/1984 | Fritzvold et al. | 162/65 |
| 4,451,332 | 5/1984 | Annergren et al. | 162/30.1 |
| 4,459,174 | 7/1984 | Papageorges et al. | 162/40 |
| 4,568,420 | 2/1986 | Nonni | 162/65 |
| 4,595,455 | 6/1986 | Mannbro | 162/38 |
| 4,619,733 | 10/1986 | Kooi | 162/30.1 |
| 4,806,203 | 2/1989 | Elton | 162/19 |
| 4,834,837 | 5/1989 | Loquenz | 162/56 |
| 4,840,703 | 6/1989 | Malmsten | 162/49 |

OTHER PUBLICATIONS

Elton et al., "New Technology for Medium-Consistency Oxygen Bleaching".

Fossum et al., "Final Bleaching of Kraft Pulps Delignified to Low Kappa Number by Oxygen Bleaching", Tappi Journal pp. 60-62 (Dec. 1983).

Fujii, et al., "Oxygen Pulpimg of Hardwoods," TAPPI, Alkaline Pulping/Secondary Fibers Conference (Washington, D.C., Nov. 7-10, 1977).

Gellerstedt et al., "Singlet Oxygen Oxidation of Lignin Structures," *Singlet Oxygen,* Chapter 31, pp. 302-310, (Sep. 1976).

Germgard et al., "Mathematical Models for Simulation and Control of Bleaching Stages", Nordic Pulp and Paper Research Journal, No. 1 (1987).

Gierer, "Chemistry of Delignification, Part 2: Reactions of Lignins During Bleaching", Word Science and Technology (1986).

Gierer, "Mechanisms of Bleach with Oxygen-Containing Species", ISWPC, (1987).

Gupta, et al., "OZ Prebleaching, Influence on Viscosity and Sheet Strength", TAPPI Symposium—Oxygen Delignification, p. 1 (1984).

Heimburger et al., "Kraft Mill Bleach Plant Effluents: Recent Developments Aimed at Decreasing Their Environmental Impact".

Heimburger et al., "Kraft Mill Bleach Plant Effluents: Recent Developments Aimed at Decreasing Their Environmental Impact Part II", TAPPI Journal, p. 69 (Nov. 1988).

Jamieson et al., "Integration of Oxygen Bleaching in the Brown Stock Washing System", Svensk Papperstidning (1973).

Kirk et al., "Low Consistency Oxygen Delignification in a Pipeline Reactor", TAPPI, vol. 61, No. 5.

Leopold, B., "The Pulp Mill of the Future", *Textile and Paper Chemistry and Technology,* p. 239.

Leopold, B., "The Pulping Process—Opportunity or Headache?", Proceedings of IPC Conference, Paper Science and Technology, May 8-10, 1979.

Liebergott, et al., "The Use of Ozone in Bleaching and Brightening Wood Pulps: Part I—Chemical Pulps" (TAPPI 1978).

Liebergott, et al., "The Use of Ozone or Oxygen in the First Bleaching State", *Ozone: Science and Engineering,* vol. 4, p. 109 (1982).

Liebergott, et al., "Bleaching a Softwood Kraft Pulp Without Chlorine Compounds", TAPPI Journal, p. 76 (Aug. 1984).

Liebergott, et al., "Bleaching a Softwood Kraft Pulp Without Chlorine Compounds", pp. 1-10.

Liebergott et al., "Comparison Between Oxygen and Ozone Delignification in the Bleaching of Kraft Pulps", TAPPI Proceedings—1981 Pulping Conference, p. 157.

(List continued on next page.)

OTHER PUBLICATIONS

McDonough, "Oxygen Bleaching's Pace Quickens", IPC Technical Paper Series, No. 246 (Jul. 1987).

Ohnishi, K., "Japan: Pulping, Bleaching", *Pulp and Paper* (Aug. 1978) p. 88.

Ow, et al., "Advances In Ozone Bleaching: Part II—Bleaching of Softwood Kraft Pulps With Oxygen and Ozone Combination", TAPPI Symposium—Oxygen Delignification (1984).

Partridge, H., "New Pulp Bleaching Developments", *CEP* (Jun. 1976).

Partridge, H., "An Overview of New Pulp Bleaching Developments" AICHE National Meeting, Paper No. 24a, (Sep. 7-10, 1975).

Perkins et al., "Advances in Ozone Bleaching-Part III—Pilot Plant Installations and Proposed Commercial Implementation".

Seifert et al., "Engineering Considerations in the Design of Oxygen Reactors", p. 309.

Singh, "The Bleaching of Pulp", TAPPI, 3rd ed., Chapter 7 (1979).

Smook, "Bleaching, Handbook For Pulp & Paper Technologies"—Chapter 11 (TAPPI).

Soteland, N., "Bleaching of Chemical Pulps With Oxygen and Ozone", Pulp and Paper Magazine of Canada, vol. 75, No. 4 (Apr., 1974) p. 91.

Soteland, N., "Bleaching of Chemical Pulps with Oxygen and Ozone", *Norsk Skogindustri* (Sep. 1978) p. 199.

Soteland, "Comparison Between Oxygen and Ozone Delignification of Sulphite Pulps", TAPPI Symposium-Oxygen Delignification p. 71 (1984).

Wong et al., "Toxicity, BOD and Color of Effluents From Novel Bleaching Processes", *Pulp and Paper Magazine of Canada,* vol. 79, No. 7 (Jul. 1978) p. 41.

PROCESS FOR ENHANCED OXYGEN DELIGNIFICATION USING HIGH CONSISTENCY AND A SPLIT ALKALI ADDITION

FIELD OF INVENTION

The present invention relates to a method for the treatment of wood pulp, and more particularly to a method for oxygen delignification of brownstock to produce highly delignified pulp without deleteriously affecting strength.

BACKGROUND OF THE INVENTION

Wood is comprised in major proportion of cellulose and hemicellulose fiber and amorphous, non-fibrous lignin which serves to hold the fibrous portions together. The hemicellulose and the cellulose are sometimes referred to collectively as holocellulose. During the treatment of wood to produce pulp, the wood is transformed into a fibrous mass by removing a substantial portion of the lignin from the wood. Thus, processes for the production of paper and paper products generally include a pulping stage in which wood, usually in the form of wood chips, is reduced to a fibrous mass. Several different pulping methods are known in the art; they are generally classified as mechanical, chemical or semi-chemical pulping.

Chemical pulping methods include a wide variety of processes, such as the sulfite process, the bisulfite process, the soda process and the Kraft process. The Kraft process is the predominant form of chemical pulping.

Chemical pulping operations generally comprise introducing wood chips into a digesting vessel where they are cooked in a chemical liquor. In the Kraft process, the cooking liquor comprises a mixture of sodium hydroxide and sodium sulfide. After the required cooking period, softened and delignified wood chips are separated from the cooking liquor to produce a fibrous mass of pulp. The pulp produced by chemical pulping is called "brownstock." The brownstock is typically washed to remove cooking liquor and then processed for the production of unbleached grades of paper products or, alternatively, bleached for the production of high brightness paper products.

Since chromophoric groups on the lignin are principally responsible for color in the pulp, most methods for the bleaching of brownstock require further delignification of the brownstock. For example, the brownstock may be reacted with elemental chlorine in an acidic medium or with hypochlorite in an alkaline solution to effect this further delignification. These steps are typically followed by reactions with chlorine dioxide to produce a fully bleached product. Oxygen delignification is a method that has been used at an increasing rate in recent years for the bleaching of pulp because it uses inexpensive bleach chemicals and produces by-products which can be burned in a recovery boiler reducing environmental pollutants. Oxygen delignification is frequently followed by bleach stages which use chlorine or chlorine dioxide but require less bleach chemical and produce less environmental pollutants because of the bleaching achieved in the oxygen stage.

In some bleaching processes, the pulp is bleached while being maintained at low to medium levels of pulp consistency. Pulp consistency is a measure of the percentage of solid fibrous material in pulp. Pulps having a consistency of less than about 10% by weight are said to be in the low to medium range of pulp consistency.

Processes which require bleaching at low to medium consistency are described in the following patents and publications: U.S. Pat. No. 4,198,266, issued to Kirk et al; U.S. Pat. No. 4,431,480, issued to Markham et al; U.S. Pat. No. 4,220,498, issued to Prough; and an article by Kirk et al. entitled "Low-consistency Oxygen Delignification in a Pipeline Reactor—A Pilot Study", TAPPI, May 1978. Each of the foregoing describe an oxygen delignification step that operates upon pulps in the low to medium consistency range.

U.S. Pat. No. 4,806,203, issued to Elton, discloses an alkaline extraction, preferably for chlorinated pulp, wherein the timed removal of alkaline solution is essential to prevent redepositing of dissolved lignin back onto the pulp. If too short or too long of a time period passes in this stage, the process shows little benefit.

Oxygen delignification of wood pulp can be carried out on fluffed, high consistency pulp in a pressurized reactor. The consistency of the pulp is typically maintained between about 20% and 30% by weight during the oxygen delignification step. Gaseous oxygen at pressures of from about 80 to about 100 psig is introduced into and reacted with the high consistency pulp. See, G.A. Smook, *Handbook for Pulp and Paper Technologists*, Chapter 11.4 (1982). In previous oxygen delignification operations, the pulp after cooking is washed and dewatered to produce a high consistency mat. The pulp mat is then covered with a thin film or layer of an alkaline solution, by spraying the solution onto the surface of the mat. The amount of alkaline solution sprayed onto the mat is about 0.8 to 7% by weight of oven dry pulp.

Previously used high consistency oxygen delignification processes have several disadvantages. In particular, it has now been found that spraying an alkaline solution otto a mat of high consistency pulp does not provide an even distribution of solution throughout the fibrous mass, notwithstanding the generally porous nature of such mats. As a result of this uneven distribution, certain areas of the high consistency mat, usually the outer portions, are exposed to excessive amounts of the alkaline solution. This excessive exposure is believed to cause nonselective degradation of the holocellulosic materials resulting in a relatively weak pulp, at least locally. On the other hand, other portions of the high consistency mat, typically the inner portions, may not be sufficiently exposed to the alkaline solution to achieve the desired degree of delignification. Thus, overall quality declines.

SUMMARY OF THE INVENTION

The present invention provides a novel, two-stage addition of alkaline material throughout and upon pulp in a method for the production of delignified pulp by a high consistency oxygen delignification process wherein the delignified pulp has greater strength and a lower lignin content than has been attainable by prior art processes.

In accordance with the present invention, a first amount of alkaline material is applied to pulp at low consistency. The low consistency pulp is combined with a quantity of alkaline material in an aqueous alkaline solution in a manner to obtain a substantially uniform distribution of the first amount of alkaline material throughout the pulp. This uniform distribution of the first amount of alkaline material is sufficient to assist in the enhancement of delignification selectivity during high consistency oxygen delignification compared to processes where the alkaline material is only applied upon high consistency pulp or is only applied at very low amounts onto low consistency pulp.

Following the low consistency addition of alkaline material to the pulp, the consistency of the pulp is then increased to a high consistency of at least about 18%. The step of increasing the pulp consistency includes pressing or otherwise processing the low consistency pulp in a manner to remove pressate containing alkaline material while retaining the first amount of alkaline material distributed throughout the pulp. A first portion of this pressate can be recycled to the low consistency pulp treatment step, while a second portion can be discharged to the plant recovery system to maintain water balance.

After increasing the pulp consistency, a second amount of alkaline material is applied thereto to adjust the total amount of alkaline material on the pulp to between about 0.8 and 7 percent by weight based on oven dry pulp. After this two step alkaline material treatment, the pulp is then subjected to oxygen delignification whereby enhanced delignification is achieved.

The present invention also facilitates the pulp bleaching processes that follow the high consistency oxygen delignification of the alkaline material treated pulp. These processes utilize less bleaching chemicals to produce bleached paper products having superior strength compared to paper products made according to conventional high consistency pulp oxygen delignification processes. Alternatively, the process enables one to achieve similar lignin contents (i.e., K Nos. or Kappa numbers) after delignification as are achieved by the prior art while providing better strength (i.e., higher viscosities), or to achieve pulp which exhibits greater brightness compared to prior art pulps when exposed to the same amount of bleaching chemical. In addition, these better delignification selectivities (i.e., lower K Nos. or Kappa numbers at equal or higher viscosities than prior art alkaline material treated pulp) are achieved while retaining easy control of the process due to upset conditions or changes in the pulp to be delignified.

DESCRIPTION OF PREFERRED EMBODIMENTS

The present invention provides high quality, high strength, delignified wood pulp from Kraft pulp or pulps produced by other chemical pulping processes. The preferred starting material is unbleached pulp obtained by cooking wood chips or other fibrous materials in a cooking liquor, such as by the Kraft or Kraft AQ process.

Figure 1:
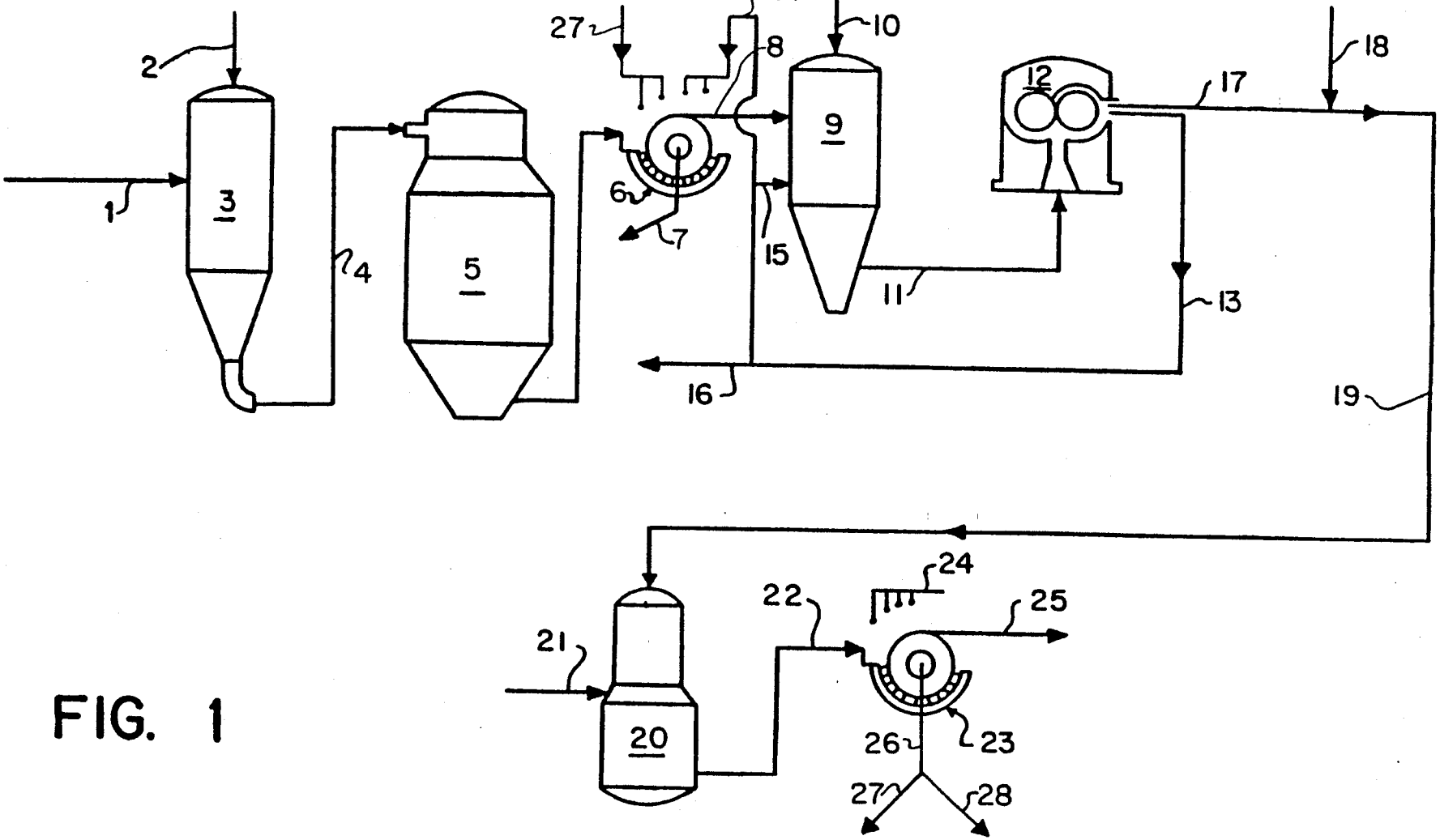
FIG. 1 is a schematic representation of one embodiment of the present invention.

With reference to FIG. 1, wood chips 1 and a white liquor 2 comprising sodium hydroxide and sodium sulfide are introduced into a digester 3. Sufficient white liquor should be introduced into the digester to substantially cover the wood chips. The contents of the digester are then heated at a temperature and for a time sufficient to allow the white liquor to substantially impregnate the wood chips and substantially complete the cooking reaction.

This wood chip cooking step is conventionally known as Kraft cooking or the Kraft process and the pulp produced by this process is known as Kraft pulp or Kraft brownstock. Depending upon the lignocellulosic starting material, the delignification results obtained with the conventional Kraft process may be increased by the use of extended delignification techniques or the Kraft-AQ process. Moreover, these techniques are preferred for obtaining the greatest degree of reduction in K No. of the pulp without deleteriously affecting the strength and viscosity properties of the pulp during the cooking stage.

When using the Kraft-AQ technique, the amount of anthraquinone in the cooking liquor should be an amount of at least about 0.01% by weight, based on the oven dried weight of the wood to be pulped, with amounts of from 0.02 to about 0.1% generally being preferred. The inclusion of anthraquinone in the Kraft pulping process contributes significantly to the removal of the lignin without adversely affecting the desired strength characteristics of the remaining cellulose. Also, the additional cost for the anthraquinone is partially offset by the savings in cost of chemicals utilized in the bleaching steps which follow oxygen delignification of the pulp.

Alternatively or additively to Kraft-AQ is the use of techniques for extended delignification such as the Kamyr MCC, Beloit RDH and Sunds Super Batch Methods. These techniques also offer the ability to remove more of the lignin during cooking without adversely affecting the desired strength characteristics of the remaining cellulose.

The digester 3 produces a black liquor containing the reaction products of lignin solubilization together with brownstock 4. The cooking step is typically followed by washing to remove most of the dissolved organics and cooking chemicals for recycle and recovery, as well as a screening stage (not shown) in which the pulp is passed through a screening apparatus to remove bundles of fibers that have not been separated in pulping. The brownstock 4 is treated in washing units comprising, in sequence, a blow tank 5 and washing unit 6 where residual liquor 7 contained in the pulp is removed.

The washed brownstock 8 is then introduced into a mixing chest 9 where it is substantially uniformly combined with sufficient alkaline material for a time sufficient to distribute a first amount of alkaline material throughout the pulp. During this treatment, the brownstock is maintained at a pulp consistency of less than about 10% and preferably less than about 5% by weight. The consistency of the pulp is generally greater than about 0.5%, since lesser consistencies are not economical to process in this manner. A most preferred consistency range is 0.5 to 4.5%.

One skilled in the art can select the appropriate quantities (i.e., concentrations and flow rates) of alkaline solution and pulp treatment times in this step to achieve a distribution of the desired amount of alkaline material throughout the pulp. In particular, an aqueous sodium hydroxide solution is combined with the low consistency pulp in an amount sufficient to provide at least about 0.4% to about 3.5% by weight of sodium hydroxide on pulp based on oven dry pulp after thickening. Other alkali sources having equivalent sodium hydroxide content can also be employed, if desired, such as oxidized white liquor.

The alkaline material treated pulp 11 is forwarded to a thickening unit 12 where the consistency of the pulp is increased, for example, by pressing to at least about 18% by weight and preferably from about 25% to about 35%. The pulp consistency increasing step also removes residual liquid or pressate 13. As shown in FIG. 1, a portion 14 of this pressate 13 may be directly recycled back to the washer 7. Alternatively, a portion 15 may instead be directed to mixing chest 9 for use in the low consistency pulp alkaline treatment step. Since the consistency of the pulp is increased in the thickening unit 12, a certain amount 16 of pressate may continually be discharged to the plant recovery system to maintain water balance in the mixing chest 9.

A first portion 27 of the oxygen stage washer 23 filtrate 26 can be used to advantage in a first shower on the brownstock washer 6. This improves washing and reduces the pressate portion 14 which is used in a second shower on washing unit 6 and later returns into the residual liquor 7 which is sent to the plant recovery without further reuse. A second portion 28 of filtrate 26 is discharged directly to the plant recovery system.

One skilled in the art would clearly recognize and understand the difference between the "quantity" of alkaline material utilized in or combined with the low consistency pulp and the "amount" which is applied to or is retained upon the pulp. To retain the desired amount of alkaline material upon the pulp after pressing, a significantly larger quantity of alkaline material must be combined with the low consistency pulp in mixing chest 9. Also, any alkaline material lost to the recovery system due to pressate discharge through line 16 must be replaced, and such replacement amounts are generally added to the low consistency pulp treatment. Thus, the quantity of alkaline material which is utilized (i.e., present) in the mixing chest is always greater than the amount actually applied upon (i.e., retained within or upon) the pulp after pressing to high consistency.

Additional alkaline material 18 is applied to the high consistency brownstock 17 produced by the thickening unit 12 to obtain the desired total amount of alkaline material on the pulp prior to oxygen delignification. This total amount of alkaline material is selected to achieve the desired extent of delignification in the subsequent oxygen delignification step which is carried out on the alkaline material treated high consistency pulp. The total amount of alkaline material actually applied onto the pulp will generally be between 0.8 and 7% by weight based on oven dry ("OD") pulp, and preferably between about 1.5 and 4% for southern softwood and between about 1 and 3.8% for hardwood. About half these amounts are preferably applied in each of the low consistency and high consistency treatments. Thus, about 0.5 to 2% by weight, preferably about 0.5 to 1.9% for hardwood and 0.75 to 2% for softwood, is applied onto the pulp during each of the low and high consistency alkaline treatments.

The high consistency alkaline treatment step allows rapid modification or adjustment of the amount of the alkaline material present in or upon the pulp which will enter the oxygen delignification reactor 20. By adjusting the amount of alkaline material 18 applied onto the pulp during the high consistency treatment, prolonged equilibrium adjustments during the low consistency treatment are avoided. The increased speed in achieving equilibrium of the high consistency alkaline solution treatment allows for a more rapid response of the oxygen system to changing delignification requirements in that the precise total amount to be applied to the pulp can be easily and rapidly varied to compensate for changes in the properties (i.e., wood type, K No. and viscosity) of the incoming brownstock, or to vary the degree or extent of oxygen delignification for a particular pulp.

The fully alkaline treated pulp 19 is then forwarded to the oxygen delignification reactor 20 where it is contacted with gaseous oxygen 21 by any of a number of well known methods. Suitable conditions for oxygen delignification according to the present invention comprise introducing gaseous oxygen at about 80 to about 100 psig to the high consistency pulp while maintaining the temperature of the pulp between about 90° and 130° C. The average contact time between the high consistency pulp and the gaseous oxygen ranges from about 15 minutes to about 60 minutes.

After oxygen delignification in reactor 20, the delignified pulp 22 is forwarded to a second washing unit 23 wherein the pulp is washed with water 24 to remove any dissolved organics and to produce high quality, low color pulp 25. From here, pulp 25 can be sent to subsequent bleaching stages to produce a fully bleached product.

Additional advantages of the present invention can be obtained during the subsequent bleaching of pulp 25. Such bleaching can be conducted with any of a wide variety of bleaching agents, including ozone, peroxide, chlorine, chlorine dioxide, hypochlorite or the like. When conventional chlorine/chlorine dioxide bleaching processes are used to increase the degree of brightness of the pulps which have been treated with alkaline material as described above, a substantially reduced amount of total active chlorine is used compared to the bleaching of pulps which are oxygen delignified by prior art techniques. The total amount of chlorine-containing chemicals utilized according to the present invention is reduced by about 15 to 35% by weight compared to the amount needed for the same starting pulp which is not treated with alkaline material at low pulp consistency. Similarly, when the chlorine/chlorine dioxide treated pulp is followed by an alkaline extraction stage, substantially reduced amounts of alkaline material are needed in this stage compared to a bleaching process for pulps which have not been uniformly combined with alkaline material at low consistency. The amount of alkaline material utilized in the extraction step would be reduced by about 25 to 40% by weight for pulp treated with alkaline material at low consistency as disclosed herein.

In addition to providing cost advantages with respect to the reduced amounts of chemical necessary for such treatments, the process of the present invention also reduces the amounts of environmental pollutants caused by the use of chlorine, since reduced amounts of chlorine are used. Furthermore, due to the lower usage of chemicals in this portion of the system, the amount of contaminants in the waste water from the plant which is to be treated is correspondingly reduced with similar savings in waste water treatment facilities and related costs.

EXAMPLES

In order to illustrate the benefits and superior performance of the methods of the present invention, several tests were conducted utilizing the treatment procedure depicted in FIG. 1.

As the term is used herein, delignification selectivity is a measure of cellulosic degradation relative to the extent of lignin remaining in the pulp and is an indication of the ability of the process to produce a strong pulp with low lignin content. Differences in delignification selectivity for oxygen delignification of a particular pulp can be shown, for example, by comparing the ratio of pulp viscosity to K No. or Kappa number. For this invention, the lignin content of the pulp may be measured by either K No. or Kappa number. One skilled in the art can recognize the difference between these values and can convert one number to the other, if desired.

The viscosity of a bleached pulp is representative of the degree of polymerization of the cellulose in the bleached pulp and as such is representative of the pulp. On the other hand, K No. represents the amount of lignin remaining in the pulp. Accordingly, an oxygen delignification reaction that has a high selectivity produces a bleached pulp of high strength (i.e., high viscosity) and low lignin content (i.e., low K No.).

EXAMPLE 1

Prior Art High Consistency Pulp Alkaline Treatment

Southern pine Kraft brownstock having a K No. of about 24 (Kappa number of 30.9) was pressed without alkaline solution treatment to a consistency of about 30–36% by weight to produce a high consistency mat of brownstock. The mat of brownstock was sprayed with a 10% sodium hydroxide solution in an amount sufficient to produce approximately 2.5 weight percent sodium hydroxide based on pulp dry weight. Dilution water was added in an amount sufficient to adjust the brownstock mat to about 27% consistency. The high consistency brownstock mat was then subjected to oxygen delignification using the following conditions: 110° C., 30 minutes, 80 psig $O_2$. The oxygen delignified pulp produced according to this procedure was tested and found to have a K No. of 13 (Kappa number of 15.2) and a CED viscosity of about 14.8 cps. This oxygen delignified pulp was further bleached by known technology. The strength and physical properties of both the oxygen delignified pulp and the fully bleached pulp are shown in Tables 1 and 2, respectively.

TABLE 1

Comparison of Oxygen Stage Delignification Results on Pulps Produced by Example 1 and Example 2

| | EXAMPLE 1 | EXAMPLE 2 |
|---|---|---|
| K No. | 13 | 9 |
| Viscosity (cps) | 14.8 | 14.0 |
| Ratio of Viscosity/ K No. | 1.14 | 1.55 |

TABLE 2

Comparison of Fully Bleached Strength Properties of Pulps Produced by Example 1 and Example 2

| EXAMPLE 1 | | EXAMPLE 2 | |
|---|---|---|---|

TABLE 2-continued

| C.S. | Final G.E. brightness, % | | | |
|---|---|---|---|---|
| | 83 | | 83 | |
| Freeness, ml. | Breaking Length-km | Tear Factor, $Dm^2$ | Breaking Length-km | Tear Factor, $Dm^2$ |
| 658 | 6.42 | 55.7 | 7.00 | 55.5 |
| 516 | 8.25 | 73.6 | 8.35 | 67.4 |
| 337 | 8.80 | 74.1 | 9.07 | 71.8 |

Bleaching of the oxygen delignified pulp was conducted in three stages: chlorine, caustic extraction and chlorine dioxide. The final bleached pulp of 83 G.E. brightness was obtained using the bleaching and extraction conditions of Table 3 and the chemical charges (percent based on OD pulp) listed in Table 4. Also, the pulps were well washed between bleaching stages.

TABLE 3

Bleaching Conditions in the Chlorine, Extraction and Chlorine Dioxide Stages for Example 1 and Example 2

| | |
|---|---|
| Chlorine Stage | |
| Time, min. | 15 |
| Temperature, °C. | 50 |
| Consistency, % | 3 |
| Extraction Stage | |
| Time, min. | 60 |
| Temperature, °C. | 70 |
| Consistency, % | 12 |
| Chlorine Dioxide Stage | |
| Time, min. | 120 |
| Temperature, °C. | 60 |
| Consistency, % | 12 |

TABLE 4

Bleach Chemical Usage in Chlorine, Extraction and Chlorine Dioxide Stages

| | EXAMPLE 1 | EXAMPLE 2 |
|---|---|---|
| Chlorine Stage | | |
| Chlorine, % on fiber | 3.6 | 2.4 |
| Chlorine Dioxide, % | 0.6 | 0.4 |
| Extraction Stage | | |
| Sodium Hydroxide, % | 1.5 | 1.5 |
| Chlorine Dioxide Stage | | |
| Chlorine Dioxide, % | 0.28 | 0.23 |

EXAMPLES 2–5

Low Consistency Pulp Alkaline Treatment

Examples 2–5 illustrate the benefits in degree of delignification and delignification selectivities obtained during high consistency oxygen delignification for pulps which are treated with alkaline material only at low consistency.

EXAMPLE 2

The same pine Kraft brownstock as used in Example 1 was introduced into a mixing chest, such as 9 of FIG. 1. Sufficient dilution water was added to obtain a brownstock consistency of about 3% by weight in the mixing chest. A sufficient volume of 10% NaOH solution was added to effect a 30% NaOH addition based on OD pulp. The brownstock and the aqueous sodium hydroxide solution were uniformly mixed at room temperature for about 15 minutes to combine the alkaline material with the brownstock. The resulting alkaline material containing brownstock was then pressed to a consistency of about 27% by weight. After pressing, the sodium hydroxide on the fiber equaled about 2.5%, as in Example 1. The alkaline material treated brownstock was then bleached according to the oxygen delignification procedure described in Example 1. The oxygen delignified pulp was then washed to remove organics. The resulting oxygen stage pulp had a K No. of 9 (Kappa number of 10.8) and a CED viscosity of 14.0. The oxygen bleached pulp was further bleached by known technology at the conditions shown in Example 1. The properties of the oxygen delignified pulp and the fully bleached pulp of this Example are also shown above in Tables 1 and 2, respectively.

As can be seen from a comparison of Examples 1 and 2, the procedure of Example 2 produced an oxygen delignified pulp having greater delignification (lower K No.) at about the same viscosity than the prior art method of Example 1 which applies all the alkaline material upon the high consistency pulp. Furthermore, utilizing a low consistency alkaline treatment of pulp in accordance with Example 2 provides enhanced delignification without significant change in strength properties. Thus, increased delignification selectivity is achieved.

As a result of the lower K Nos. of pulp produced by Example 2, subsequent bleaching steps can be adjusted to accommodate the higher delignified pulp. Thus, the bleaching stages for such pulp require less bleaching agents (as shown in Table 4) or shorter bleaching times than for pulp which is not treated with alkaline material at low consistency.

EXAMPLE 3

Pulp produced from softwood (pine) in a process similar to that of Example 2 is compared to that produced conventionally (i.e. with no low consistency alkaline treatment step) as in Example 1. The average sodium hydroxide dosage applied only to high consistency pulp for subsequent oxygen delignification of the pulp was found to be 45 pounds per oven dried ton (lb/t) or 2.3%. At that level, the average reduction in K No. across the oxygen delignification reactor was 10 units. For the same level of sodium hydroxide applied only to the low consistency pulp prior to high consistency oxygen delignification, an average K No. drop during delignification was found to be 13 units: a 30% increase compared to the prior art.

The average K No. and viscosity for conventional pulp was 12.1 and 14.4 cps, respectively. For the low consistency alkaline material treatment process, the average K No. at essentially the same viscosity (14.0 cps) was 8.3, an increase in delignification selectivity of about 41% (1.69 vs. 1.19), as shown in Table 5.

Bleach plant response for pulps prepared according to the above low consistency alkaline treatment process was compared to that for pulps prepared conventionally and is shown below in Table 5.

TABLE 5

Pulp Property and Bleach Chemical Comparison (Pine)

| | Conventional | Low Consistency Treated |
|---|---|---|
| Digester | | |
| K No. | 21.9 | 20.5 |
| Viscosity (cps) | 21.5 | 20.5 |
| Ratio of Viscosity/K No. | .98 | 1.0 |
| $O_2$ Delignification Stage | | |
| K No. | 12.1 | 8.3 |
| Viscosity (cps) | 14.4 | 14.0 |

TABLE 5-continued

Pulp Property and Bleach Chemical Comparison (Pine)

| | Conventional | Low Consistency Treated |
|---|---|---|
| Ratio of Viscosity/K No. | 1.19 | 1.69 |
| Caustic, lb/t | 39.4 | 46.0 |
| Delignification (%) | 44.7 | 59.5 |
| Bleach Plant | | |
| Chlorine/Chlorine Dioxide Stage | | |
| $Cl_2$, lb/t | 51.2 | 34.4 |
| $ClO_2$, lb/t | 7.0 | 4.6 |
| Tot. Act. Cl, lb/t | 69.4 | 46.4 |
| Extraction Stage | | |
| NaOH, lb./t | 35.2 | 23.8 |
| Chlorine Dioxide Bleach Stage | | |
| $ClO_2$, lb/t | 10.6 | 9.0 |
| Viscosity (cps) | 12.6 | 11.9 |
| Dirt | 5.6 | 2.5 |

Table 5 illustrates that total active chlorine usage in the next stage of bleaching was reduced by about ⅓ (i.e., 69.4 pounds per ton vs. 46.4 pounds per ton). In addition, sodium hydroxide requirements for the extraction stage were also reduced by about ⅓ (24 lb/t vs. 35 lb/t). Chlorine dioxide in the final bleaching stage was reduced by about 1/6 (9 lb/t vs. 10.6 lb/t).

EXAMPLE 4

Comparison tests similar to Example 3 were carried out for hardwood pulp. Again, it was found that a significantly larger K No. drop across the oxygen delignification reactor is achieved using a treatment process where alkaline material is applied only to low consistency pulp compared to conventional processing. The sodium hydroxide dosage for oxygen delignification of hardwood is 27 lb/t, or 1.4%. A K No. drop of about 5 units during the delignification step was obtained for the conventional process. For the same level of sodium hydroxide utilized according to the above low consistency process, an average K No. drop of about 7.3 units was obtained, an increase of almost 50%.

The average hardwood K No. and viscosity were found to be 7.6 and 16 cps, respectively. For the above low consistency treatment, a K No. of 6 and a viscosity of 17.7 was obtained. Also, the K No. at the same viscosity as the prior art alkaline material treated pulp (16 cps), was found to be 5.8. An increase of delignification selectivity of about 40% (2.95 vs. 2.10) is achieved, as shown in Table 6.

Delignification selectivity can also be expressed in terms of the change in viscosity versus the change in K No. between brownstock and delignified pulps. In comparing pulps which are treated with alkaline material only at low consistency to those of the prior art, there is a greater increase in delignification selectivity for increased degrees of delignification. For a change in K No. of 4 units, the average change in viscosity was 4 cps for pulps produced by the conventional process. By contrast, the change in K No. for the same change in viscosity for pulps produced by the low consistency pulp treatment was 7 units. Expressed in terms of a selectivity ratio, the selectivity for the low consistency treated pulp was 1.75 and that for the conventional process was 1 (cps/K No.), an increase of about 75%.

A comparison of bleach plant response of oxygen delignified pulps prepared using the above low consistency alkaline material treatment in terms of bleach chemical application is compared to conventionally prepared oxygen delignified pulps in Table 6.

TABLE 6

Pulp Property and Bleach Chemical Comparison (Hardwood)

| | Conventional | Low Consistency Treated |
|---|---|---|
| Digester | | |
| K No. | 12.3 | 13.0 |
| Viscosity (cps) | 21.6 | 23.4 |
| Ratio of Viscosity/K No. | 1.75 | 1.80 |
| $O_2$ Delignification Stage | | |
| K No. | 7.6 | 6.0 |
| Viscosity (cps) | 16.0 | 17.7 |
| Ratio of Viscosity/K No. | 2.10 | 2.95 |
| Caustic, lb/t | 27.6 | 26.4 |
| Delignification (%) | 38.0 | 54.0 |
| Bleach Plant | | |
| Chlorine/Chlorine Dioxide Stage | | |
| $Cl_2$, lb/t | 27.0 | 22.7 |
| $ClO_2$, lb/t | 5.6 | 4.7 |
| Tot. Act. Cl, lb/t | 41.6 | 34.9 |
| Extraction Stage | | |
| NaOH, lb./t | 18.9 | 13.3 |
| Chlorine Dioxide Bleach Stage | | |
| $ClO_2$, lb/t | 5.5 | 4.7 |
| Viscosity (cps) | 14.6 | 14.9 |
| Dirt | 32.0 | 34.0 |

Table 6 illustrates that total active chlorine usage in the chlorine stage was reduced by about 1/6 (i.e., 34.9 lb/t compared to 41.6 lb/t), while caustic requirements for the extraction stage were reduced by more than 29% (i.e., 13.3 lb/t vs. 18.9 lb/t) compared to prior art pulp. The chlorine dioxide in the final bleaching stage was reduced by more than 14% (i.e., 4.7 lb/t vs. 5.5 lb/t). The final pulp properties with regard to viscosity and dirt values were essentially the same.

EXAMPLE 5

To illustrate the effect of 100% low consistency alkaline material treatment on pulp prior to oxygen delignification and its contribution to the overall effectiveness of kappa drop and total yield, the kappa number and yield were determined for both conventional and low kappa number kraft/AQ brownstocks. The results are presented in Table 7.

TABLE 7

| | | LOW CONSISTENCY ALKALINE TREATMENT | | | OXYGEN DELIGNIFICATION | | |
|---|---|---|---|---|---|---|---|
| Brownstock | Time (Min.) | Initial Kappa Number | Final Kappa Number | Yield (%) | Kappa Number | Yield (%) | Final Viscosity (CPS) |
| [1]Conven. | 5 | 28.1 | 26.5 | 99.5 | 12.0 | 95.2 | 14.7 |
| [2]Conven. | 15 | 28.1 | 27.5 | 98.7 | 13.4 | 96.3 | 15.1 |
| [3]K/AQ | 5 | 21.6 | 20.3 | 100.0 | 8.9 | 96.7 | 15.2 |
| [4]K/AQ | 5 | 21.6 | — | — | 8.1 | 97.2 | 13.9 |

[1]2.4% NaOH
[2]2.1% NaOH
[3]2.1% NaOH
[4]2.6% NaOH

For a conventional kraft brownstock having a Kappa number of 28.1 treated with sodium hydroxide (2.4% on pulp after pressing) at 3% consistency for 5 minutes, the starting Kappa number decreased 1.6 units to a post treated Kappa number of 26.5. This represented a 9.6% contribution to the total Kappa number drop experienced following alkaline treatment and oxygen delignification (Kappa number of 12.0). The yield across the low consistency alkaline treatment stage was 99.5%. Approximately half of the 0.5% loss in yield can be attributed to loss of lignin with the remainder due to a loss in carbohydrates. The total yield after oxygen delignification was 95.2%.

The same starting brownstock was treated with sodium hydroxide (2.1% on pulp after pressing) at 3% consistency for 15 minutes. The starting Kappa number decreased 0.6 units to a Kappa number of 27.5. This represented a 4.2% contribution to the total Kappa number drop experienced following low consistency alkaline treatment and oxygen delignification (Kappa number of 13.4). The yield across the alkaline treatment stage was 98.7%.

For a low Kappa number kraft/AQ brownstock treated with sodium hydroxide (2.11% on pulp after pressing) at 3% consistency for 5 minutes, the Kappa number decreased 1.3 units to 20.3. This Kappa number drop represented a 10% contribution to the total Kappa number drop experienced following oxygen delignification (Kappa number of 8.9). There was essentially no yield loss detected across the alkaline treatment stage. The total yield loss following oxygen delignification was 96.7%. A second oxygen delignification of the same kraft/AQ starting brownstock resulted in a similar Kappa number of 8.1 and yield of 97.2%.

This Example 5 shows that no significant amount of delignification occurs during the low consistency alkaline treatment of the pulp. This example also shows that there is no significance to the time of treatment with alkaline material at low consistency up to about 15 minutes. As is further shown by Examples 2-5, however, the low consistency alkaline treatment does significantly increase the relative amount of delignification obtained during subsequent high consistency oxygen delignification step as compared to pulps treated in the conventional manner. This example also shows that the process is effective with a low Kappa number brownstock in taking the pulp to a very low Kappa number without any significant decrease in viscosity.

The uniform distribution of the alkaline material throughout the pulp during the low consistency combining step ensures that the pulp fibers are more optimally associated with the alkaline material than is otherwise possible according to prior techniques. This results in enhanced delignification selectivity during subsequent oxygen delignification in that the delignified brownstocks have strength and degrees of delignification that are generally superior to those attainable by the prior art. Also, the delignification selectivity of the oxygen delignification reaction is unexpectedly improved.

For the present invention, the minimum amount of alkaline material applied onto the low consistency pulp is that which, in combination with the amount applied onto the high consistency pulp, is sufficient to increase or enhance delignification selectivity of the pulp during the oxygen delignification stage. As shown in the following Examples, at least about 50% of the total amount of alkaline material to be applied to the pulp prior to oxygen delignification should be applied to the low consistency pulp. If less than about 50% is applied to the low consistency pulp, the advantages regarding delignification selectivity significantly decrease.

When alkaline material is applied only to high consistency pulp as in the prior art, a delignification (i.e., reduction in K No.) of up to 50% can be achieved without substantially damaging the cellulose portions (and thus without substantially reducing the strength) of the pulp. In the present invention, it is possible to obtain a reduction in K No. for the incoming pulp of greater than 50% and generally at least about 60% during oxygen delignification with essentially no damage to the cellulose portion of the pulp. Reductions of 70% and more can be achieved, if desired.

For example, upon entering the oxygen delignification stage, pulp K Nos. for the particular pulp range from about 10 to 26, depending upon the type of wood and type of pulping conducted upon the particular wood. After delignification, the K No. is reduced to about 5 to 10. For softwood pulp, K Nos. generally range from 20–24 (target of 21) prior to delignification, while after delignification, the K Nos. are in the range of 8–10. For hardwood pulp, K Nos. of 10–14 (target 12.5) prior to delignification and K Nos. of 5–7 after delignification are generally obtained by the present process.

For either type of pulp, the viscosity prior to delignification is generally about 19 or greater, while after delignification is above about 13 (generally 14 or above for softwood and 15 or above for hardwood). Typically, this change in viscosity from before to after delignification would be about 6 cps. or less. Moreover, it has been found that the change in viscosity per change in K No. is a constant for decreases in K No. up to about 17 units.

Thus, delignification selectivity is enhanced by the 100% low consistency alkali treatment process, with an increase of at least 20% in delignification compared to prior art delignification processes. The avoidance of deterioration of the cellulose component of the pulp is evident by the minimal change in viscosity of pulp from before to after oxygen delignification.

The following examples of the invention illustrate how the present invention achieves delignification selectivities comparable to the 100% low consistency pulp alkaline treatment process of Examples 2–5 while reducing the amount of alkaline material removed to the recovery system.

EXAMPLE 6

The following experiment involving 6 samples illustrates the effect on delignification selectivity of the two step split addition alkaline material pulp treatment process of the present invention. Results are set forth in Tables 8 and 9. For comparison purposes, samples A (100% alkali applied to low consistency pulp) and B (100% alkali applied to high consistency pulp), were included in the Tables.

The starting brownstock used in the experiment was Southern pine. This material was digested in a conventional manner to form brownstock. The 40 ml K No. of the brownstock was 22.1, and the 25 ml K No. was 19.8. The viscosity of the pulp was 24.5 cps.

This pulp was diluted to a low consistency of about 3.5%. A sufficient amount of alkaline material was distributed throughout this pulp by the addition of oxidized white liquor solution. The pulp consistency was then increased to about 27% to retain, after pressing, the amount of alkaline material throughout the pulp shown in Table 8.

A second amount of alkaline material, also shown in Table 8, was then applied to the high consistency pulp. The alkali solution used to apply the stated amounts was oxidized white liquor containing 84.5 g/l sodium hydroxide and 0.1% magnesium sulfate.

The alkaline treated high consistency pulp was then directed to the oxygen reactor 20 (FIG. 1) which was operated at a temperature of 110° C., at a pressure of 80 psig for 30 minutes. The total alkaline material applied in both the low and high consistency pulp treatments ranged from about 2.96 to 4.23% as shown in Table 8. The actual splits of alkaline material on pulp between the low and high consistency pulp treatments are shown in Table 8, while the resulting viscosities, K Nos. and selectivity ratios for the oxygen delignified pulp are shown in Table 9.

TABLE 8

| Sample | Low Consistency Alkali Addition (% on pulp) | High Consistency Alkali Addition (% on pulp) | Total Alkali Addition (% on pulp) |
|---|---|---|---|
| A | 3.10 | 0 | 3.10 |
| 1 | 2.33 | 0.63 | 2.96 |
| 2 | 2.25 | 1.17 | 3.42 |
| 3 | 1.81 | 1.80 | 3.61 |
| 4 | 1.39 | 2.34 | 3.73 |
| 5 | 1.06 | 2.92 | 3.98 |
| 6 | 0.63 | 3.60 | 4.23 |
| B | 0 | 4.50 | 4.50 |

TABLE 9

| Sample | % Added at High Consistency | Viscosity (cps) | K No. (25 ml) | Ratio of Viscosity to K No. |
|---|---|---|---|---|
| A | 0 | 14.9 | 10.1 | 1.475 |
| 1 | 21.4 | 15.1 | 9.65 | 1.565 |
| 2 | 34.3 | 13.7 | 9.96 | 1.376 |
| 3 | 49.8 | 15.3 | 10.08 | 1.518 |
| 4 | 62.7 | 14.0 | 10.66 | 1.313 |
| 5 | 73.4 | 14.3 | 11.82 | 1.210 |
| 6 | 85.2 | 13.9 | 11.16 | 1.246 |
| B | 100 | 14.4 | 12.80 | 1.125 |

The results show that the samples applying up to 49.8% (i.e., about 50%) of the alkaline material to the high consistency pulp provides enhanced delignification and selectivity ratios in that lower K Nos. are achieved at equal or higher viscosities. Samples 1, 2 and 3 provide delignified pulps which are comparable to that of comparative sample A, where 100% of the alkaline material is applied to low consistency pulp. Samples 1–3 and A are preferred due to the increased delignification selectivities compared to samples 4–6 and B, viscosity decreases while K Nos. increase. Further bleaching of the pulps of samples 4–6 and B would require additional bleaching chemical compared to the pulps of samples 1–3 and A due to the higher K Nos. of the pulps of samples 4–6 and B. These results demonstrate that split alkaline additions of at least 50% in the low consistency stage retain the enhanced delignification achievable by the addition of all alkaline material to the low consistency pulp.

EXAMPLE 7

Figure 2:
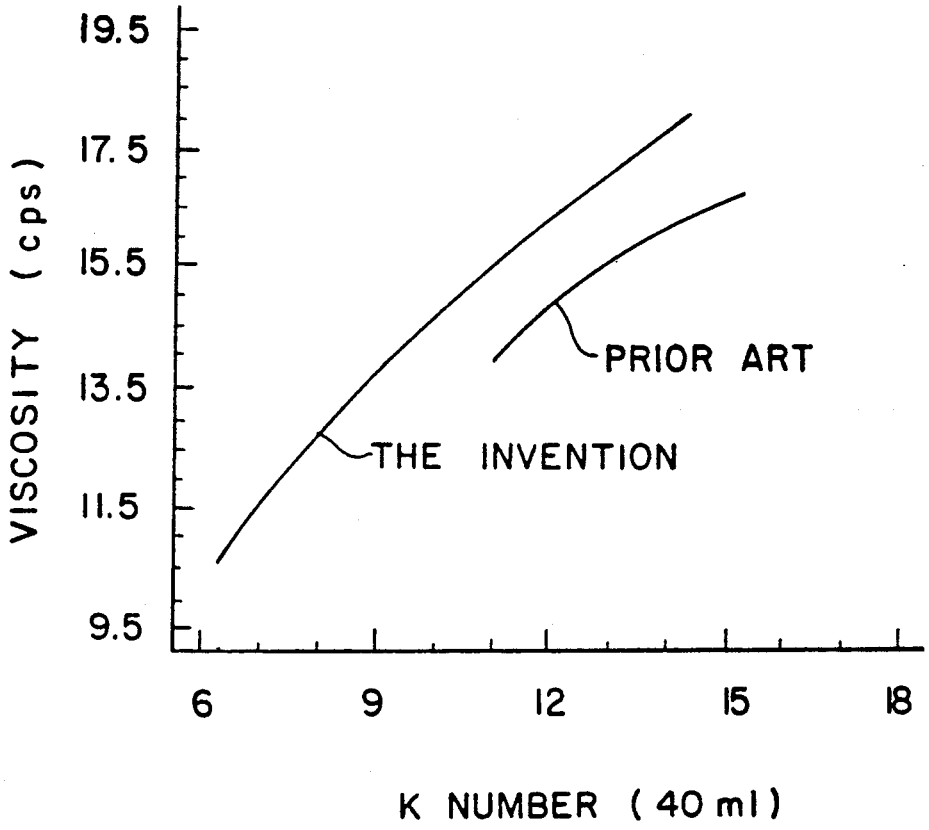
FIG. 2 is a graph showing the relationship between pulp viscosity and K No. for softwood pulps treated with alkaline material and delignified by oxygen according to the invention compared to those representative of the prior art.
Figure 3:
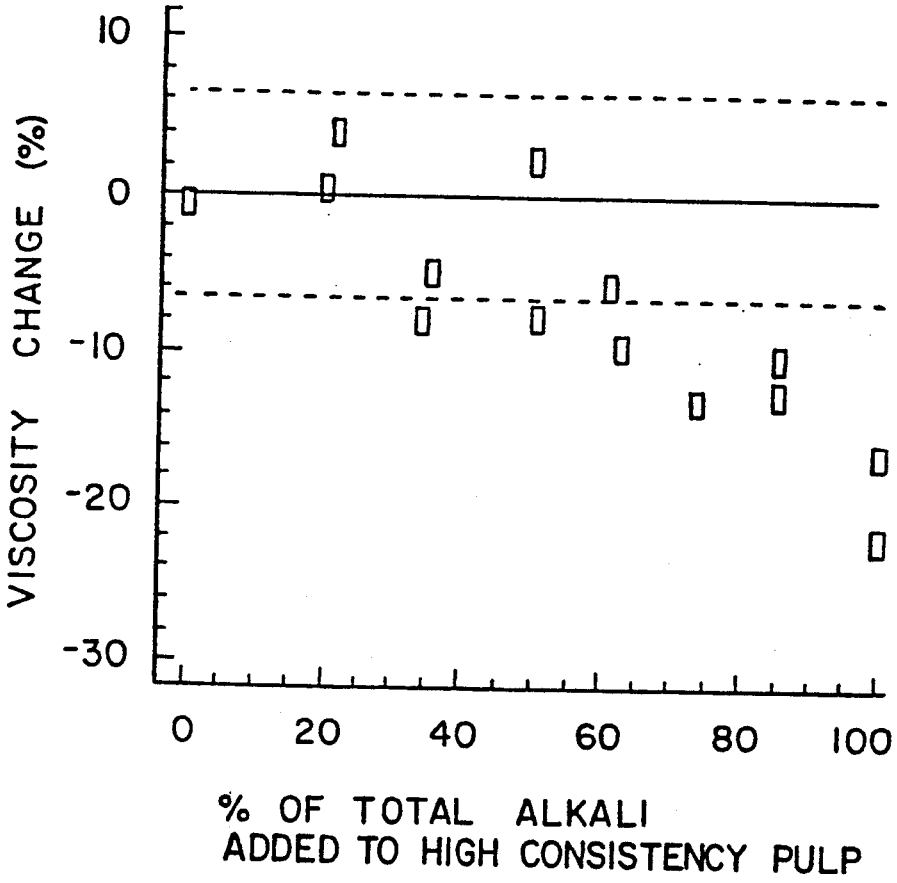
FIG. 3 is a graph showing the relationship between percent viscosity change and the proportion of alkaline material added to the high consistency pulp for pulps treated with alkaline material and delignified by oxygen according to the invention compared to pulps treated with alkaline material only at low consistency or only at high consistency.

The data presented in Examples 2 through 6, along with numerous other predicted and observed values, have been compiled for softwood pulp in graphical form in FIGS. 2 and 3. FIG. 2 also includes curves generated from combined data from actual tests, and numerous other predicted and observed results, which illustrates the relationship of viscosity to K No. for softwood from the prior art pulp treatment process of Example 1.

As shown in FIG. 2, the prior art process of Example 1 achieves typical pulp properties after oxygen delignification defined by the curve labeled Prior Art. It is desirable to maintain pulp strength, as measured by viscosity, at higher viscosity levels, while achieving effective delignification as measured by a decrease in K No. FIG. 2 illustrates that enhanced delignification (lower K Nos.) may be attained at a given viscosity value according to the curve representing the invention, for a low consistency pulp alkaline material treatment as compared to the lesser delignification and viscosity values according to the Prior Art curve.

FIG. 3 illustrates the effect of increasing the percentage of alkaline material utilized in treating the high consistency pulp. The solid horizontal line proximate to the 0 viscosity change numeral corresponds to the baseline viscosity achieved with 100% of the alkaline material applied on the low consistency pulp. The two broken horizontal lines on either side of the solid 0 line delineate the boundaries of a typical ±6% deviation in viscosity. As is evident from FIG. 3, as the amount of alkaline material added to the high consistency pulp exceeds about 50% of the total alkaline material applied in pulp treatment, viscosity of the pulp drops below the acceptable deviation.

As high consistency treatment of the pulp increases in percentage, there is consequently less alkaline material utilized in low consistency treatment. It is within the low consistency treatment step that the substantially uniform application of alkaline material onto the pulp is accomplished. As less alkaline material is available for the low consistency step, the selectivity advantages of low consistency treatment are diminished. Thus, any split addition process achieves some improvement in delignification selectivity compared to the application of all alkaline material to the high consistency pulp. The best results in delignification selectivities are achieved for a split addition where no more than about 50% of the total alkaline material is added to the high consistency pulp.

EXAMPLE 8

It has been found that for Southern Pine Kraft brownstock, a target value of 2.4% based on oven dry pulp of sodium hydroxide on the pulp is needed prior to oxygen delignification to obtain the desired delignification level. In order to provide 2.4% of sodium hydroxide on the pulp entering the oxygen reactor, approximately 43.2 pounds per air dried ton (lb/ADT) of sodium hydroxide is required.

The amount of alkaline material lost due to the discharge of various portions of pressate is illustrated in Table 10.

TABLE 10

LB/ADT ALKALINE MATERIAL APPLIED TO PULP PRIOR TO OXYGEN DELIGNIFICATION

| Pressate Discharged To Recovery (%) | Split (%) of alkaline material added to low consistency pulp | | | |
|---|---|---|---|---|
| | 100% | 80% | 60% | 50% |
| 0 | 43.2 | 43.2 | 43.2 | 43.2 |
| 20 | 54 | 51.8 | 50.0 | 48.6 |
| 40 | 72 | 66.2 | 60.5 | 57.6 |
| 60 | 108 | 95.0 | 82.1 | 75.6 |

It should be noted that the values listed in Table 10 refer to the total amount of alkaline material applied to pulp by the process: i.e., the amount applied by the low consistency treatment plus the amount applied to the high consistency pulp (if applicable). The 50% split column at zero pressate discharge thus indicates that 21.6 lb/ADT are applied to the low consistency pulp in the mixing chest and 21.6 lb/ADT are applied to the high consistency pulp. The same 50% split at 20% pressate discharge shows that in addition to the 21.6 lb/ADT applied to the low consistency pulp, an additional 5.4 lb/ADT must be added to the system (a total of 27 lb/ADT) to compensate for the amount lost by pressate discharge. This additional amount is generally added to the mixing chest in order to maintain the amount applied to the high consistency pulp at no more than about 50% of the total amount.

Table 11 illustrates the same data of Table 10, but quantifies the amount of additional alkaline material that should be added to the low consistency treatment to achieve the target 2.4% NaOH on the pulp. As the percentage of alkaline material applied to the high consistency pulp increases up to 50%, less additional alkaline material must be added to the low consistency treatment to maintain the proper amount of alkaline material on the pulp available for high consistency oxygen delignification. With zero pressate discharge, no alkaline material is lost.

TABLE 11

LB/ADT ALKALINE MATERIAL APPLIED TO LOW CONSISTENCY PULP TO COMPENSATE FOR PRESSATE DISCHARGED

| Pressate Discharged To Recovery (%) | Split (%) of alkaline material added to low consistency pulp | | | |
|---|---|---|---|---|
| | 100% | 80% | 60% | 50% |
| 20 | 10.8 | 8.6 | 6.8 | 5.4 |
| 40 | 28.8 | 23 | 17.3 | 14.4 |
| 60 | 64.8 | 51.8 | 38.9 | 32.4 |

Table 12 illustrates the same data of Table 10 and 11, but presents only the amount of alkaline material (and corresponding weight percentage in parentheses) which is added to the low consistency pulp for 20, 40 and 60% of pressate discharged.

TABLE 12 lb/ADT (% of total) Alkaline Material Applied to Low Consistency Pulp

| Pressate Discharged (%) | Split (%) of alkaline material added to low consistency pulp | | | |
|---|---|---|---|---|
| | 100% | 80% | 60% | 50% |
| 0 | 43.2 (100%) | 34.6 (80%) | 25.9 (60%) | 21.6 (50%) |
| 20 | 54 (100%) | 43.2 (83.4%) | 32.7 (65.4%) | 27 (55.5%) |
| 40 | 72 (100%) | 57.6 (87%) | 43.2 (71.4%) | 36 (62.5%) |
| 60 | 108 | 86.4 | 64.8 | 54 |

TABLE 12-continued

| Pressate Discharged (%) | lb/ADT (% of total) Alkaline Material Applied to Low Consistency Pulp — Split (%) of alkaline material added to low consistency pulp | | | |
|---|---|---|---|---|
| | 100% | 80% | 60% | 50% |
| | (100%) | (90.9%) | (73.79%) | (71.4%) |

These data show that using the split alkaline material addition process of the invention, at least 50% and preferably about 55 to about 90% of the total amount of alkaline material is added to the low consistency pulp in mixing chest 9 to compensate for amounts of alkaline material removed to the recovery system by pressate discharge. The balance of the alkaline material is added to the high consistency pulp.

Examining the values corresponding to 100% alkaline material applied to the low consistency pulp, it is expected, and the results indicate, that as the percentage of alkaline material lost to pressate discharge increases, a corresponding increase in alkaline material added to the pulp is necessary. For the situation where all alkaline material is combined with the low consistency pulp, the amount of alkaline material in the pressate discharge 16 sent to the recovery system is significantly higher than when only a portion of the total alkaline material is utilized during the low consistency treatment. As the percentage of alkaline material applied to the low consistency pulp decreases due to the split addition, the amount of additional alkaline material that must be added to replace alkaline material lost in the pressate discharge diminishes, because less alkaline material is utilized in the low consistency treatment.

Thus, applying lesser proportions of the alkaline material onto the low consistency pulp reduces the quantity of alkaline material utilized in the mixing chest 9 and also reduces the amount of alkaline material removed via pressate discharge. This splitting of the alkaline material applied to low and high consistency pulp reduces the amount of pressate discharge 16 which in turn reduces the amount of alkaline material which must be reintroduced, thus saving chemical.

EXAMPLE 9

The conservation of alkaline material due to the split addition of alkaline material for a preferred treatment process is illustrated in Table 13. More particularly, the flow of alkaline material into and out of the alkaline material treatment steps appears in Table 13 for a 600 air dried tons per day (ADT/d) pulp treatment process. The comparative sample is representative of a process where all alkaline material is utilized and applied only to the low consistency pulp.

Oxidized white liquor is utilized as the source of alkaline material, at a concentration of 105 g/l. The consistency of the pulp 8 exiting the washer 6 is 15%, is diluted to about 3.5% in the mixing chest 9, while after thickening unit 12, the consistency of the pulp 17 is increased to 27%.

For a preferred embodiment of the process of the present invention, 30% of the total amount of alkaline material applied to the pulp entering oxygen delignification reactor 20 is applied to the high consistency pulp, while the balance, 70%, is applied to the low consistency pulp during the treatment in mixing chest 9. For a pressate discharge to recovery of 14.6% of the amount of alkaline material added to the mixing chest 9, only 5.1 lb./ton of alkaline material is lost. In the comparative process, all alkaline material 10 is applied to the low oonsistency pulp. Thus, for the same pressate discharge of 14.6%, 7.4 lbs/ton of alkaline material is lost: a 45% increase over that of the present invention.

Furthermore, since the total quantity of alkaline material applied onto the pulp entering the oxygen reactor is the same, and since more than 50% of the alkaline material is applied to the low consistency pulp, comparable delignification selectivities would be expected for each pulp. As shown in Table 13, the advantage of the present process is a significant savings of alkaline material which would otherwise be lost in the pressate 16 discharged to the recovery system.

While it is apparent that the invention herein disclosed is well calculated to fulfill the objectives stated above, it will be appreciated that numerous modifications and embodiments may be devised by those skilled in the art. It is intended that the appended claims cover all such modifications and embodiments as fall within the true spirit and scope of the present invention.

What is claimed is:

1. A process for obtaining enhanced delignification selectivity of brownstock pulp during high consistency oxygen delignification which comprises:

applying a first amount of alkaline material to brownstock pulp having a low consistency of less than about 5% by weight by combining the low consistency pulp with a sufficient quantity of alkaline material with uninterrupted mixing in a manner to ensure that all pulp fibers are exposed to the alkaline material to obtain a substantially uniform distribution of alkaline material throughout the pulp, and then increasing the consistency of the alkaline material containing pulp to at least about 18% by weight to obtain high consistency pulp and to remove pressate while retaining the first amount of alkaline material substantially uniformly distributed throughout the high consistency pulp, said pulp fibers containing the alkaline material being directly passed from the combining step to the consistency increasing step;

recycling a substantial portion of at least about 40% of the pressate directly to the alkaline material combining step;

applying a second amount of alkaline material onto the high consistency pulp to obtain a total amount of alkaline material on the pulp of at least about 0.8 to 7 percent by weight based on the oven dry weight of the pulp;

oxygen delignifying the alkaline material containing high consistency pulp to obtain enhanced delignifi-

TABLE 13

| Process | lb./hr. (lb./ton) Alkaline Material — Added at Mixing Chest | Added after Thickening Unit | Added in Total | In Pressate Discharged To Recovery | Applied to Pulp Entering Oxygen Reactor |
|---|---|---|---|---|---|
| Invention | 884 (35.2) | 329 (13.1) | 1213 (48.3) | 129 (5.1) | 1084 (43.2) |
| Comparative | 1269 (50.6) | none | 1269 (50.6) | 185 (7.4) | 1084 (43.2) |

cation of the brownstock pulp without a corresponding decrease in pulp viscosity compared to brownstock pulp which is not combined with alkaline material at low pulp consistencies;

wherein at least about 55% to about 90% of the total amount of alkaline material is added to the low consistency pulp.

2. The process of claim 1 wherein the pulp has a low consistency of about 3% by weight when combined with the quantity of alkaline material.

3. The process of claim 1 wherein the consistency of the pulp is increased to between about 25 and 35% by weight prior to applying the second amount of alkaline material.

4. The process of claim 1 wherein the oxygen delignifying step obtains enhanced delignification selectivity by decreasing the K No. of the high consistency pulp by greater than 50% without significantly damaging the cellulose components of the pulp.

5. The process of claim 6 wherein the K No. is decreased from about 10 to 26 before delignification to about 5 to 10 after delignification.

6. The process of claim 1 wherein the pulp is unbleached softwood pulp and the total amount of alkaline material applied to the pulp is between about 1.5 and 4 percent by weight.

7. The process of claim 1 wherein the pulp is unbleached hardwood pulp and the total amount of alkaline material applied to the pulp is between about 1 and 3.8 percent by weight.

8. A process for obtaining enhanced delignification selectivity of brownstock pulp during high consistency oxygen delignification which comprises:

applying a first amount of alkaline material to brownstock pulp having a low consistency of less than about 5% by weight by combining the pulp with a sufficient quantity of alkaline material in an aqueous alkaline solution with uninterrupted mixing in a manner to ensure that all pulp fibers are exposed to the alkaline material of the solution to obtain a substantially uniform distribution of alkaline material throughout the pulp, and then increasing the consistency of the pulp to at least about 18% by weight after completion of the combining step to obtain high consistency pulp having a predetermined K No. and to remove pressate while retaining the first amount of alkaline material substantially uniformly distributed throughout the high consistency pulp, said pulp fibers containing the alkaline material being directly passed from the combining step to the consistency increasing step;

recycling substantially all of the pressate directly to the alkaline material combining step;

applying a second amount of alkaline material onto the high consistency pulp to obtain a total amount of alkaline material on the pulp of at least about 0.8 to 7 percent by weight based on the oven dry weight of the pulp to enhance delignification selectivity during subsequent high consistency oxygen delignification; and oxygen delignifying the alkaline material containing high consistency pulp to obtain enhanced delignification of the brownstock pulp without a corresponding decrease in pulp viscosity compared to brownstock pulp which is not combined with alkaline material at low consistencies wherein the predetermined K No. is decreased by greater than 50% during oxygen delignification without significantly damaging the cellulose components of the pulp;

wherein at least about 55% to about 90% of the total amount of alkaline material is added to the low consistency pulp.

9. The process of claim 8 wherein the pulp has a low consistency of between about 0.5 and 4.5% by weight when combined with the quantity of alkaline material, and wherein the consistency of the pulp is increased to between about 25 and 35 percent by weight prior to applying the second amount of alkaline material.

10. The process of claim 8 wherein the pulp is unbleached softwood pulp and the K No. is decreased from a predetermined K No. of about 20 to 24 prior to delignification to a K No. of about 8 to 10 after delignification.

11. The process of claim 8 wherein the pulp is unbleached hardwood pulp and the K No. is decreased from a predetermined K No. of about 10 to 14 prior to delignification to a K No. of about 5 to 7 after delignification.

12. A process for obtaining enhanced delignification selectivity of unbleached brownstock pulp during high consistency oxygen delignification which comprises:

applying a first amount of alkaline material to unbleached pulp having a low consistency of less than about 5% by weight by combining the pulp with a sufficient quantity of alkaline material in an aqueous alkaline solution with uninterrupted mixing in a manner to ensure that all pulp fibers are exposed to the alkaline material of the solution to obtain a substantially uniform distribution of a first amount of about 0.4 to 3.5 percent by weight of alkaline material throughout the pulp, and then increasing the consistency of the pulp to at least about 18% by weight after completion of the combining step by removing pressate containing alkaline material from the low consistency pulp to obtain high consistency pulp having a predetermined K No. while retaining the first amount of alkaline material distributed substantially uniformly throughout the high consistency pulp, said pulp fibers containing the alkaline material being directly passed from the combining step to the consistency incrasing step;

recycling a substantial portion of at least about 40% of the pressate directly to the alkaline material combining step;

applying a second amount of about 0.4 to 3.5 percent by weight of alkaline material onto the high consistency pulp to obtain a total amount of alkaline material on the pulp of at least about 0.8 to 7 percent by weight based the oven dry weight of the pulp; and oxygen delignifying the alkaline material containing high consistency pulp to obtain enhanced delignification of the brownstock pulp without a corresponding decrease in pulp viscosity compared to brownstock pulp which is not combined with alkaline material at low consistencies by decreasing the predetermined K No. by greater than 50% during oxygen delignification without significantly damaging the cellulose components of the pulp;

wherein at least about 55% to about 90% of the total amount of alkaline material is added to the low consistency pulp.

13. The method of claim 12 which further comprises discharging a second portion of the pressate.

14. The method of claim 12 wherein the decrease in predetermined K No. during oxygen delignification is at least about 60%.

15. The process of claim 12 wherein the pulp has a low consistency of between about 0.5 and 4.5% by weight when combined with the quantity of alkaline material, and wherein the consistency of the pulp is increased to between about 25 and 35 percent by weight prior to applying the second amount of alkaline material.

* * * * *